US007954432B1

(12) United States Patent
Piegols et al.

(10) Patent No.: US 7,954,432 B1
(45) Date of Patent: Jun. 7, 2011

(54) SHIPPING CAP FOR SHIELDED MILD DETONATING CORD AND RESULTING ASSEMBLY FOR SAFE SHIPPING

(75) Inventors: Bruce Walter Piegols, Laplata, MD (US); George David Eccard, Jr., Laplata, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 237 days.

(21) Appl. No.: 12/456,265

(22) Filed: Jun. 10, 2009

(51) Int. Cl.
*F42B 39/30* (2006.01)
*C06C 5/00* (2006.01)

(52) U.S. Cl. ..... 102/275.5; 102/275.2; 102/275.8; 206/3

(58) Field of Classification Search ..... 102/202.1, 102/275.1, 275.2, 275.4, 275.5, 275.6, 275.7, 102/275.8, 275.12; 206/3
See application file for complete search history.

(56) References Cited

U.S. PATENT DOCUMENTS

| | | | | | |
|---|---|---|---|---|---|
| 3,990,367 | A | * | 11/1976 | Smith | 102/275.4 |
| 4,347,929 | A | * | 9/1982 | Poe et al. | 206/3 |
| 4,423,682 | A | * | 1/1984 | Schimmel | 102/275.2 |
| 5,223,664 | A | * | 6/1993 | Rogers | 102/275.1 |
| 5,417,162 | A | | 5/1995 | Adams et al. | |
| 5,631,440 | A | * | 5/1997 | Thureson et al. | 102/275.7 |
| 6,435,095 | B1 | * | 8/2002 | Menzel et al. | 102/275.7 |
| 7,246,558 | B2 | | 7/2007 | Hilden | |
| 2005/0150781 | A1 | | 7/2005 | Barton et al. | |

* cited by examiner

*Primary Examiner* — James S Bergin
(74) *Attorney, Agent, or Firm* — Fredric J. Zimmerman

(57) ABSTRACT

A shipping cap is provided for use with a shielded mild detonating cord (SMDC) having an explosive tip that contains a volume of explosive material. The shipping cap is coupled to a portion of the SMDC to define a sealed free volume region about the SMDC's explosive tip. The size of the free volume region is a function of the volume of explosive material contained in the explosive tip. The shipping cap's wall strength in the free volume region is defined by a factor of safety that is a function of the yield strength of the material used to construct the cap.

18 Claims, 1 Drawing Sheet

SHIPPING CAP FOR SHIELDED MILD DETONATING CORD AND RESULTING ASSEMBLY FOR SAFE SHIPPING

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to the shipping safety associated with detonation materials, and more particularly to a shipping cap for a shielded mild detonating cord and the resulting assembly formed therewith.

BACKGROUND OF THE INVENTION

"Shielded mild detonating cord" (SMDC) is used extensively in military aircrew escape systems. Typically, an SMDC consists of an extruded metal tube containing a central core of explosive material held in place by a sleeve. Both ends of the tube are fitted in an externally-threaded housing that has an explosive tip protruding therefrom. On one end of the SMDC, the tip is used as an acceptor charge for propagating a detonation wave from another device down the tube, while the other end acts as a donor charge for transferring the detonation wave to another device that can be another SMDC line. With this design, adjacent SMDC lines are explosively compatible thereby ensuring correct propagation of the detonation wave from one line to another.

Currently, a plastic cap is secured on the opposing end tips of each SMDC line to protect the tip from damage during shipping, handling, and storage. However, this shipping cap cannot contain the products of detonation of the hexanitrostibene (HNS) Type I transfer and booster charges contained in the tip. Thus, there is a substantial risk of fire and initiation of other explosives in the area should an inadvertent initiation occur while the plastic cap is in place. For these reasons, the United States Department of Defense's Ammunition and Explosives Hazard Classification Procedures require that SMDCs be packaged and shipped as Class 1 explosive articles. However, this designation considerably increases shipping, handling, and storage costs of SMDCs.

SUMMARY OF THE INVENTION

Accordingly, it is an object of the present invention to provide a shipping cap for use with a shielded mild detonating cord (SMDC).

Another object of the present invention is to provide a shipping cap that can withstand an inadvertent detonation of an SMDC when the shipping cap is coupled thereto.

Still another object of the present invention is to provide a shipping cap that, when capping the explosive tip of an SMDC, makes the entire assembly safe for shipping and handling as a non-regulated item.

Other objects and advantages of the present invention will become more obvious hereinafter in the specification and drawings.

In accordance with the present invention, a shipping cap is provided for use with a shielded mild detonating cord (SMDC) having an explosive tip that contains a volume of explosive material. The shipping cap is defined by a body adapted to be coupled to a portion of the SMDC and encapsulate the explosive tip thereof. Once coupled to the SMDC, the body defines a sealed free volume region about the SMDC's explosive tip that is about 12.25 to about 14.1 times the volume of explosive material contained in the explosive tip. The body further has wall strength in the sealed free volume region that is defined by a factor of safety of about 1.0 to about 1.15 relative to the yield strength of the material used to construct the body.

BRIEF DESCRIPTION OF THE DRAWINGS

Other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF THE INVENTION

Figure 1:
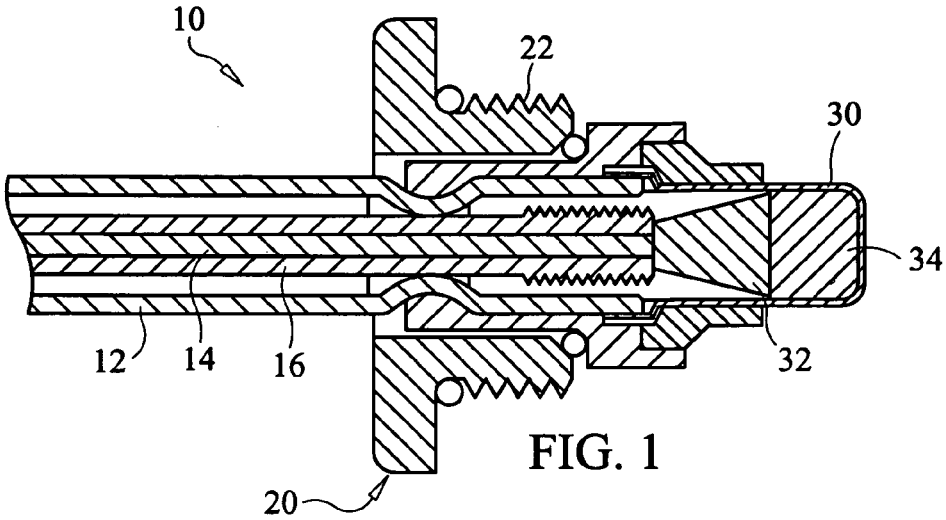
FIG. 1 is a cross-sectional view of one end region of an existing shielded mild detonating cord (SMDC)

Referring now to the drawings, a brief description will be provided for one end region of an existing shielded mild detonating cord (SMDC) that is referenced generally by numeral 10 in FIG. 1. SMDC 10 is terminated at either end of thereof in the same fashion so that only a description of one end thereof will be provided. Only the portions of SMDC 10 that are germane to the present invention will be described herein.

SMDC 10 includes a length of an extruded metal tube 12 (a portion of which is illustrated in FIG. 1) that contains a central core 14 of an explosive material retained by a sleeve 16. Each end of tube 12/core 14/sleeve 16 is captured within a housing assembly 20 that annularly encompasses and retains tube 12/core 14/sleeve 16 therein as shown. A portion 22 of housing assembly 20 is externally threaded. Protruding from and retained by housing assembly 20 is a thin-wall metal cap 30 or "tip" that houses (i) a volume of booster charge material 32 adjacent to the end of core 14, and (ii) a volume of transfer charge material 34 adjacent booster charge material 32. Charge materials 32 and 34 are explosive materials that, if initiated, cause detonation of SMDC 10. The booster charge material 32 is situated intermediate the portion 22 and the transfer charge material 34.

Figure 2:
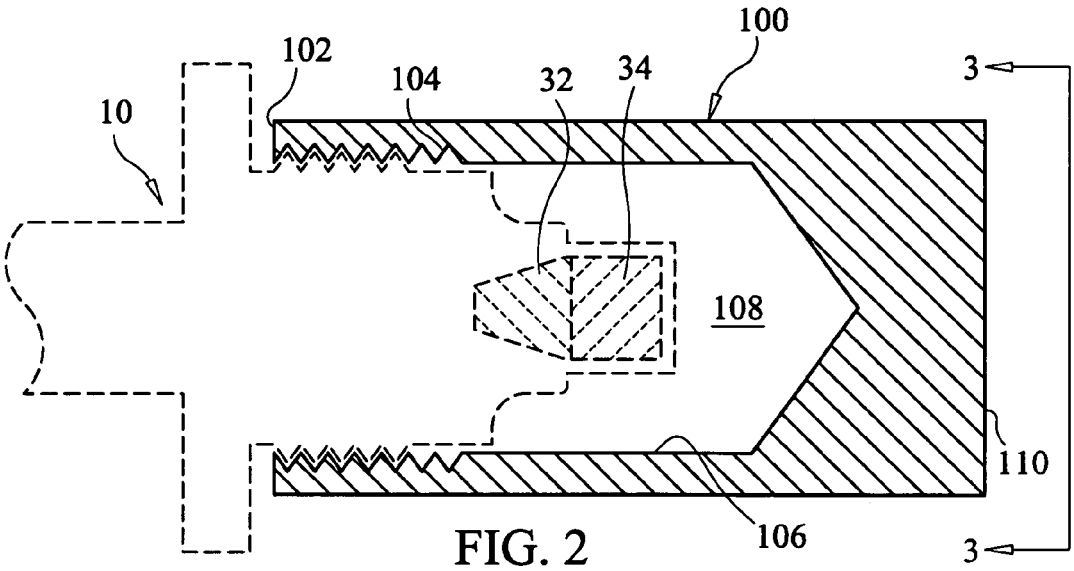
FIG. 2 is a cross-sectional view of a shipping cap coupled to one end of an SMDC in accordance with an embodiment of the present invention.
Figure 3:
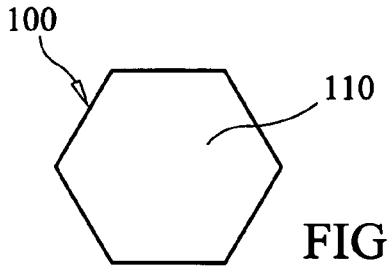
FIG. 3 is an end view of the shipping cap taken along line 3-3 in FIG. 2.

In accordance with the present invention, a shipping cap 100 for use with SMDC 10 is illustrated in FIGS. 2 and 3. When a shipping cap 100 is coupled to each opposing end of SMDC 10 as described herein, the resulting assembly will satisfy the requirements set forth for handling/shipping as a non-regulated item. In order to more clearly illustrate the features of cap 100, the end of SMDC 10 is shown in phantom in FIG. 2. In general, cap 100 is designed to be coupled to an end of SMDC 10 such that it can contain smoke, fire, fragments, noise, and temperature associated with an inadvertent detonation of charge materials 32/34. More specifically, these various detonation by-products must be controlled within specified guidelines for a non-regulated item. For example, the U.S. Department of Defense requirements for a non-regulated item are defined by the following criteria in the event of a detonation:

no visible smoke emanating from cap 100;

cap 100 cannot be cracked or ruptured;

no projection or fragments can be produced;

impulse sound level at 18 inches from cap 100 cannot exceed 140 dB; and temperature of cap 100 at the surface thereof cannot exceed 250° C.

To satisfy all of the above criteria, cap 100 is made from a rigid material (e.g., stainless steel) that can be attached to housing assembly 20. For example, cap 100 is open at one end 102 thereof and closed at an opposing end 110 thereof. End 102 has threads 104 formed in the interior thereof for mating engagement with threads 22 on housing assembly 20. Cap 100 has a bored region 106 adjacent to threads 104 such that, when cap 100 is threaded onto housing assembly 20 as shown in FIG. 2, cap 100 defines a free space or volume region 108 around metal cap 30 housing charges 32/34. Region 108 defines a sealed volume when cap 100 is tightened onto housing assembly 20.

To satisfy the above-noted criteria related to detonation containment, cap 100 has the following attributes. First, the size of region 108 must be in the range of about 12.25-about 14.1 times the volume occupied by charges 32 and 34. Second, the wall strength of cap 100 where it surrounds region 108 is defined by a factor of safety in the range of about 1.0-about 1.15 relative to the yield strength of the material used to construct cap 100. As is known in the art, the factor of safety relative to yield strength is a function of the minimum external radius of cap 100 in region 108, the maximum internal radius of bore 106, and the pressure generated by a detonation of charge materials 32/34. Thus, the factor of safety range defines the thickness of cap 100 surrounding region 108 for a given material selection of cap 100.

As mentioned above, cap 100 is tightened onto housing assembly 20 via the mating of threads 104 and 22 in order to seal region 108. For example, if cap 100 is made from stainless steel, a torque in the range of about 70-about 90 inch pounds is used when tightening cap 100 onto housing assembly 20. In order to apply the correct amount of torque, cap 100 will generally include some external surface region that can cooperate with a torque tool, e.g., a torque wrench. For example, closed end 110 can define a hexagonal perimeter as shown in FIG. 3 for engagement with a conventional torque wrench. For simplicity, the entire length of cap 100 can define the same hexagonal perimeter such that cap 100 is an open-ended hexagonal cylinder.

The advantages of the present invention are numerous. In tests of the present invention where the shipping cap 100 was coupled to either end of an SMDC 10 as described herein, the resulting assembly satisfied the requirements of a "non-regulated" item when the SMDC was detonated. The shipping cap 100 is a simple design that can be tailored to work with a variety of existing SMDCs simply by adjusting the free volume region and cap thickness surrounding same in accordance with the parameters defined herein. Accordingly, the present invention will greatly reduce shipping and handling costs currently associated with the safe transportation of SMDCs.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed as new and desired to be secured by Letters Patent of the United States is:

1. A shipping cap for a shielded mild detonating cord (SMDC) having an explosive tip that contains a volume of explosive material, comprising:

a body being adapted for coupling to a portion of the SMDC and encapsulating the explosive tip thereof, wherein said body defines a sealed free volume region about the explosive tip that is about 12.25 to about 14.1 times the volume of explosive material, and wherein said body further includes a wall strength in said sealed free volume region defined by a factor of safety of about 1.0 to about 1.15 relative to a yield strength of material used to construct said body.

2. The shipping cap as in claim 1, wherein said body includes threads at an internal region thereof adapted to engage threads on an external region of the portion of the SMDC.

3. The shipping cap as in claim 1, wherein said body comprises an external surface region thereof adapted for engagement by a tool used to couple said body to the portion of the SMDC.

4. The shipping cap as in claim 1, wherein said body comprises a hexagonal cylinder.

5. The shipping cap as in claim 1, wherein said body is comprised of stainless steel.

6. The shipping cap as in claim 1, wherein the SMDC includes a housing assembly from which the explosive tip protrudes, and wherein said housing assembly comprises threads provided on an external region thereof.

7. The shipping cap as in claim 6, wherein said body comprises an external surface region thereof adapted for engagement by a tool used to tighten said body so-threaded onto the external region of the housing assembly.

8. The shipping cap as in claim 6, wherein said body comprises a hexagonal cylinder.

9. The shipping cap as in claim 6, wherein said body includes mating threads on an internal region thereof adapted to be threaded onto the threads on the external region of the housing assembly for tightening to a torque in the range of about 70-about 90 inch-pounds.

10. A shielded mild detonating cord (SMDC) assembly, comprising:

shielded mild detonating cord (SMDC) comprising an explosive tip at each end thereof, wherein said explosive tip contains a volume explosive material; and a cap being coupled to a portion of the SMDC for encapsulating each said explosive tip thereof, wherein said cap defines a sealed free volume region about said explosive tip that is about 12.25 to about 14.1 times said volume of said explosive material, and wherein said cap further includes a wall strength in said sealed free volume region defined by a factor of safety of about 1.0 to about 1.15 relative to a yield strength of material used to construct said cap.

11. The assembly as in claim 10, wherein said cap comprises threads at an internal region thereof for engagement with threads on an external region of said portion of said SMDC.

12. The assembly as in claim 10, wherein said cap has an external surface region thereof adapted to be engaged by a tool used to couple said cap to said portion of said SMDC.

13. The assembly as in claim 10, wherein said cap comprises a hexagonal cylinder.

14. The assembly as in claim 10, wherein said cap is comprised of stainless steel.

15. The assembly as in claim 10, wherein said SMDC includes a housing assembly from which each said explosive tip protrudes, and wherein said housing assembly comprises threads provided on an external region thereof.

16. The assembly as in claim 15, wherein said cap comprises an external surface region thereof adapted for engagement by a tool used to tighten said cap so-threaded onto said external region of said housing assembly.

17. The assembly as in claim 15, wherein said cap comprises a hexagonal cylinder.

18. The assembly as in claim 15, wherein said cap includes mating threads on an internal region thereof for threaded engagement with said threads on said external region of said housing assembly, and wherein said cap is tightened onto said housing assembly with a torque in the range of about 70-about 90 inch-pounds.

* * * * *